US005624037A

United States Patent [19]

Kozo

[11] Patent Number: 5,624,037

[45] Date of Patent: Apr. 29, 1997

[54] COLLAPSIBLE LETTER TRAY KIT

[75] Inventor: Maria J. Kozo, Maryville, Tenn.

[73] Assignee: Rubbermaid Office Products Inc., Maryville, Tenn.

[21] Appl. No.: 501,667

[22] Filed: Jul. 12, 1995

[51] Int. Cl.[6] ..... B65D 6/24

[52] U.S. Cl. ..... 206/565; 206/511; 206/518; 211/128.1; 220/4.31

[58] Field of Search ..... 206/503, 509, 206/518, 511, 555, 557, 564, 565; 211/126, 128; 220/4.28, 4.31; 403/381, 244, 263

[56] References Cited

U.S. PATENT DOCUMENTS

| | | | |
|---|---|---|---|
| 903,648 | 11/1908 | Wiles . | |
| 1,403,233 | 1/1922 | Collins . | |
| 1,468,786 | 9/1923 | Knechtel . | |
| 1,579,875 | 4/1926 | Lundberg | 29/509 |
| 2,596,995 | 5/1952 | Hamilton . | |
| 2,793,407 | 5/1957 | Johnston . | |
| 3,090,086 | 5/1963 | Fatter . | |
| 3,602,422 | 8/1971 | Dewhurst . | |
| 3,759,600 | 9/1973 | MacDonald . | |
| 4,093,071 | 6/1978 | Stahl et al. | 206/518 |
| 4,138,015 | 2/1979 | Rabley | 211/126 |
| 4,170,313 | 10/1979 | Caves, et al. . | |
| 4,443,046 | 4/1984 | Hannah . | |
| 4,632,345 | 12/1986 | Barley . | |
| 4,657,148 | 4/1987 | Heng | 211/128 |
| 4,664,283 | 5/1987 | Liu | 206/509 |
| 4,776,477 | 10/1988 | Walker | 220/4.28 |
| 4,887,874 | 12/1989 | Joffe . | |
| 5,348,386 | 9/1994 | Grass . | |
| 5,368,380 | 11/1994 | Mottmiller et al. . | |
| 5,433,518 | 7/1995 | Skov . | |

*Primary Examiner*—Paul T. Sewell
*Assistant Examiner*—Luan K. Bui
*Attorney, Agent, or Firm*—Richard B. O'Planick; Lisa B. Riedesel

[57] ABSTRACT

A letter tray kit (10) is disclosed comprising a floor panel (12) and two side panels (14, 16). The floor panel comprises outwardly projecting dovetail shaped projections (32, 36) at opposite sides and the side panels comprise dovetail shaped sockets (48, 50) that receive the projections (32, 36), whereby attaching the side panels in an upright manner to the floor panel. The sockets (48, 50) are defined by spaced apart canted cantilever flanges (52, 54) and each flange has associated therewith an elongate through aperture (58, 60) of like shape and size positioned adjacent the flange so that the flanges (52, 54) can be molded through the apertures (58, 60) by a single action mold.

17 Claims, 7 Drawing Sheets

COLLAPSIBLE LETTER TRAY KIT

BACKGROUND OF THE INVENTION

1. Field of the Invention

The subject invention relates generally to plastic letter trays for use as desk top accessories and, more particularly, to such trays that are intended to be sold in a disassembled condition and later assembled by the end user.

2. The Prior Art

Plastic desktop letter trays are conventional office accessories. Typically, such trays are formed as a one-piece injection molded body, and incorporate means by which the several trays can be vertically stacked upon one another. In configuration, state of the art trays typically have a floor panel, two side panels, a back panel, and an open forward end for receipt of paper.

The conventional trays have been well accepted and are a commercial success. However, one deficiency is that the trays, being integrally formed, are substantially bulky and, hence, expensive to ship. The cost of the packaging for such products is a substantially cost component and an integrally formed tray is relatively large, requiring a relatively large amount of space in transit. The aforementioned deficiency is exacerbated in larger sized trays where the height of the sidewalls is considerable.

SUMMARY OF THE INVENTION

The subject invention solves the aforementioned problem with state of the art trays by teaching a tray that can be shipped and sold in a disassembled state, whereby saving in the cost of transportation and packaging. In the kit form, the subject tray comprises a floor panel and two side panels. For shipment, the sidepanels are stacked flat upon the floor panel and a compact form is created. The stacked components can then be packaged in a relatively small container and shipped in a cost effective manner.

The floor panel provides a rearward portion that is upwardly concave, creating a rearward wall to the letter tray. Extending from each side of the floor panel are two spaced apart projections, each having a dovetail shape. The two side panels each have inward facing dovetail-shaped sockets formed to accept the floor panel projections of a respective floor panel side, whereby attaching the side panels to the floor panel and creating with the concave floor panel rearward end portion an enclosure. The dovetail sockets are formed by spaced apart canted cantilever flanges that are separated by a side panel wall portion. Adjacent each cantilever flange is an associate elongate aperture extending through the side panel, the aperture mirroring its respective cantilever flange in width and length. The apertures provide the means for molding the cantilever flanges in a simple single action mold. Locking detents and ribs are formed within the side panels and the floor panels, and serve to retain the side panels against the floor panel sides.

Accordingly, it is an objective to provide an expensive to produce letter tray. A further objective is to provide a letter tray that is collapsible into a compact form for shipment and display.

Another objective is to provide a letter tray that is assembled from a kit form by the end user without hand tools or fasteners.

Yet another objective is to provide a letter tray kit that comprises a relatively few number of component parts that are economical to produce and simple to assemble.

These and other objectives, which will be apparent to one skilled in the art, are achieved by a preferred embodiment which is described in detail below and which is illustrated in the accompanying drawings.

DESCRIPTION OF THE PREFERRED EMBODIMENT

Figure 1:
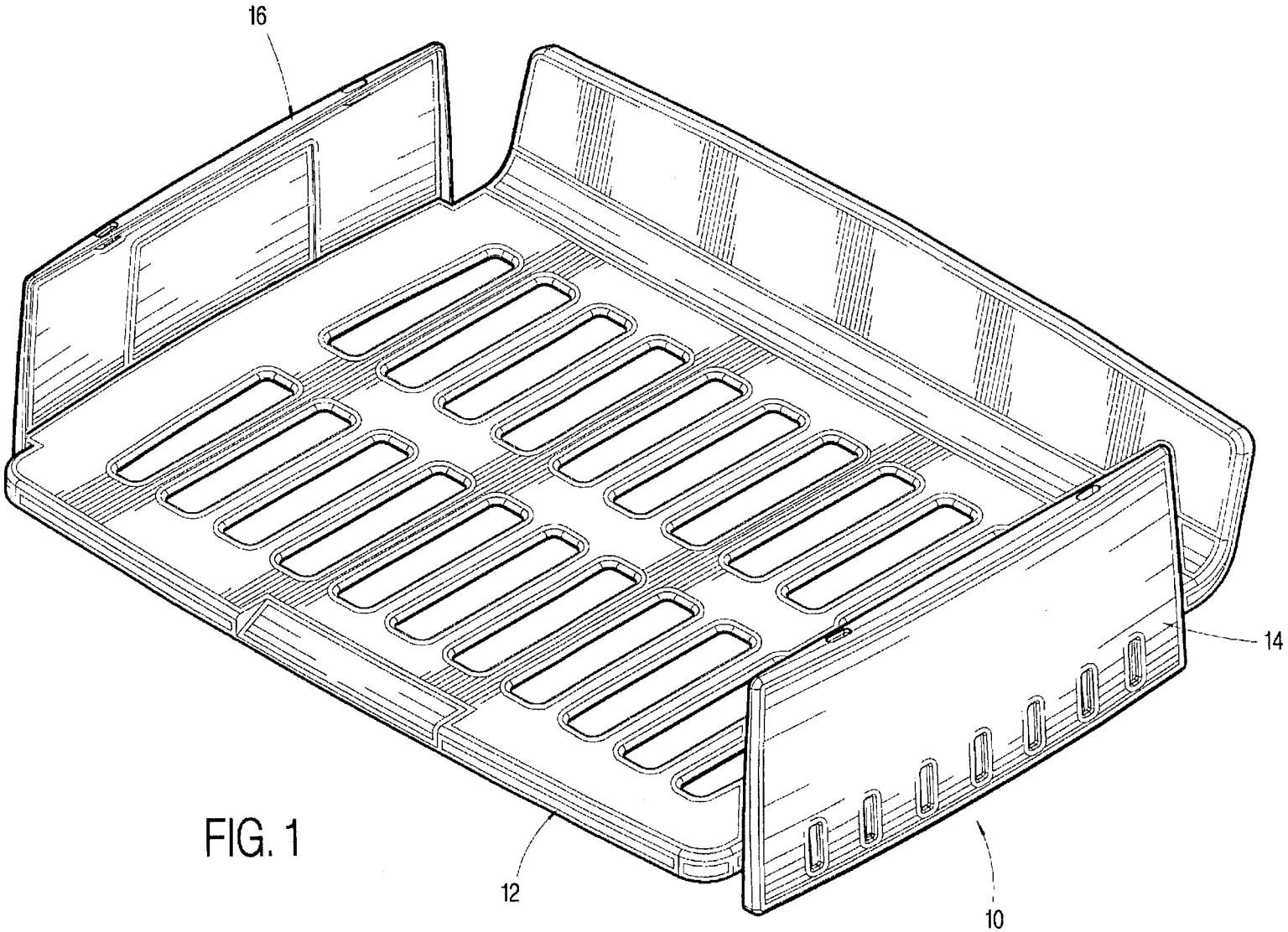
FIG. 1 is a perspective view of the assembled letter tray.
Figure 2:
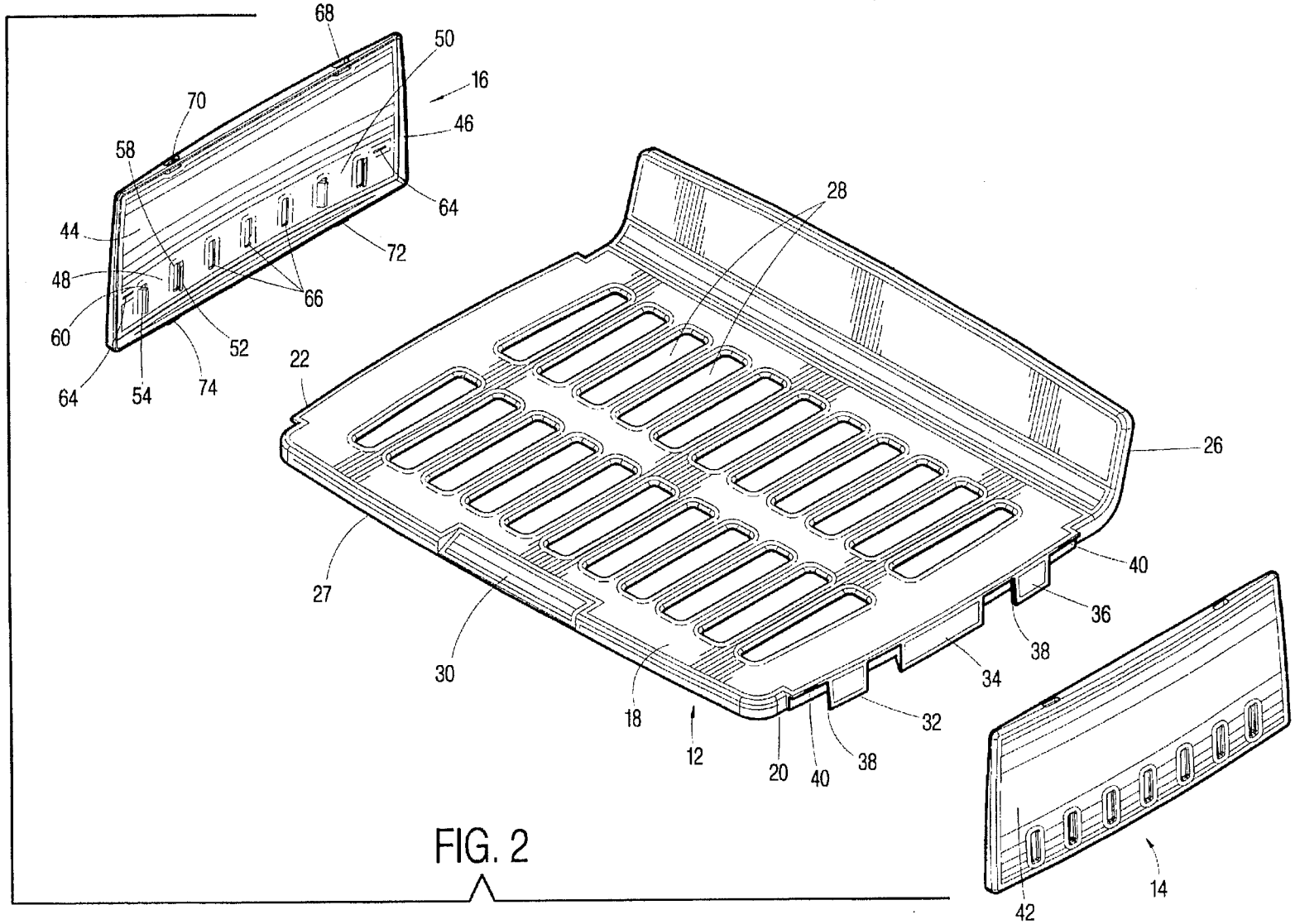
FIG. 2 is an exploded perspective view thereof.

Referring first to FIGS. 1 and 2, the subject letter tray kit 10 is shown to comprise three components: a substantially flat and rectangular floor panel 12, and two side panels 14, 16. Each component 12, 14, and 16 is molded of conventional plastic material by conventional means, preferably injection molding.

Figure 8:
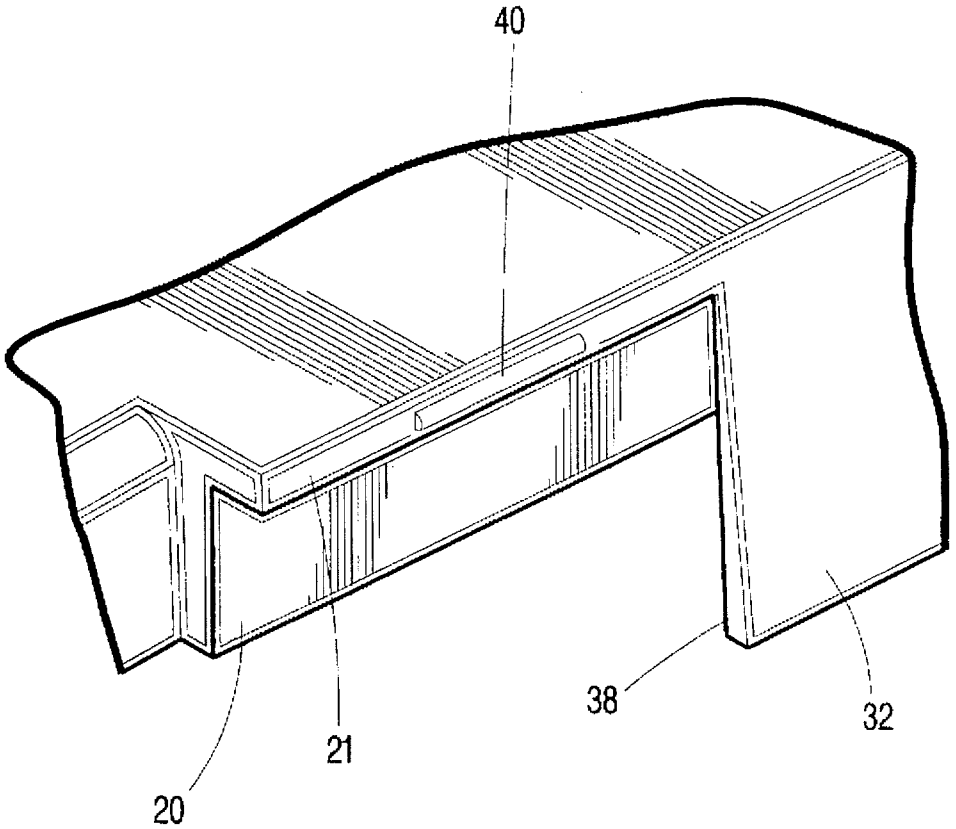
FIG. 8 is a partial enlarged perspective view of a locking rib of the kit side panels.

The floor panel 12 comprises a flat top surface 18, a pair of vertical end walls 20, 22 from each of which a horizontal overhanging ledge 21 extends. FIG. 8 shows the side configuration of the floor panel with particularity. The floor panel 12 further comprises a forward vertical side 24 and a rearward, upwardly concave, panel portion 26.

Dual rows of elongate openings 28 are positioned across the surface 18 and extend through the floor panel 12. A ramped rectangular shaped detent 30 is disposed at the center of the forward wall 24 and extends between wall 24 and the top surface 18. Depending from the leading edge of the ledge 21, as shown in FIGS. 2 and 8, is a centrally disposed reinforcement flange 34. On opposite sides of the flange 34 and likewise depending from the leading edge of the ledge 21 are two dovetail shaped projections 32, 36. Each dovetail projection is substantially flat, having narrow sidewalls 38 which, as best viewed in FIG. 8, widen in width from top to bottom.

With continued reference to FIGS. 1, 2, 4, 6, and 8, projecting outward from the overhanging ledge 21 at each side of the floor panel 12, is a forwardly disposed and a rearwardly disposed detent rib 40 of elongate configuration. The ribs 40 are disposed at each side of the panel 12 such that one rib is forward of projection 32 and one is rearward of projection 36.

The side panels 14, 16 are substantially rectangular and concave in form, having a radiussed outward surface 42, a convex inner surface 44, and a peripheral skirt 46 extending inward from the peripheral edge of the panel. Disposed along and directed inward from the inward panel surface 44 is a forwardly located dovetail-shaped socket 48 and a rearwardly located dovetail-shaped socket 50. Each socket 48, 50 is defined by spaced apart cantilevered flanges 52, 54 of elongate rectangular configuration, each flange having a beveled forward edge 55 and an inward socket defining surface 56 as best seen from FIGS. 4 and 6.

Through-apertures 58, 60 extend through the side panels 14, 16 proximate to the flanges 52, 54, each aperture 58, 60 having an elongate rectangular configuration mirroring its associate flange 52, 54, respectively. The apertures 58, 60 provide the means for molding the flanges 52, 54 is a single action mold that separates in a direction normal to the side panels 14, 16. Thus, the side panel flanges 52, 54 can be formed to create a dovetail shaped socket in a single action tool rather than a multiple action tool, considerably simplifying the manufacture thereof and substantially reducing the cost of the resultant part.

The through-apertures 58, 60 as described above, mirror the flanges 52, 54 in length and breadth. The apertures 58, 60 are separated by a portion 62 of the inward surface 44. As seen from FIGS. 4 and 6, the flanges 52, 54 are canted inwardly, and the sockets formed by canted surfaces 56 are accordingly dovetail shaped. The projections 32, 36 have correspondingly beveled edge surfaces 38 that compliment the canted surfaces 56 of the flanges 52, 54.

A pair of detent grooves 64 are formed within the inward side panel surface 44, one groove 64 forward of the socket 48 and one rearward of the socket 50. The grooves 64 are located and sized to receive the detent ribs 40 of the floor panel 12 during assembly. In addition, a series of three apertures 66 are spaced between the sockets 48, 50, each having the same size, shape, and spacing as the apertures 58, 60. The apertures 66 are for aesthetic purposes and have no associate flanges.

Figure 3:
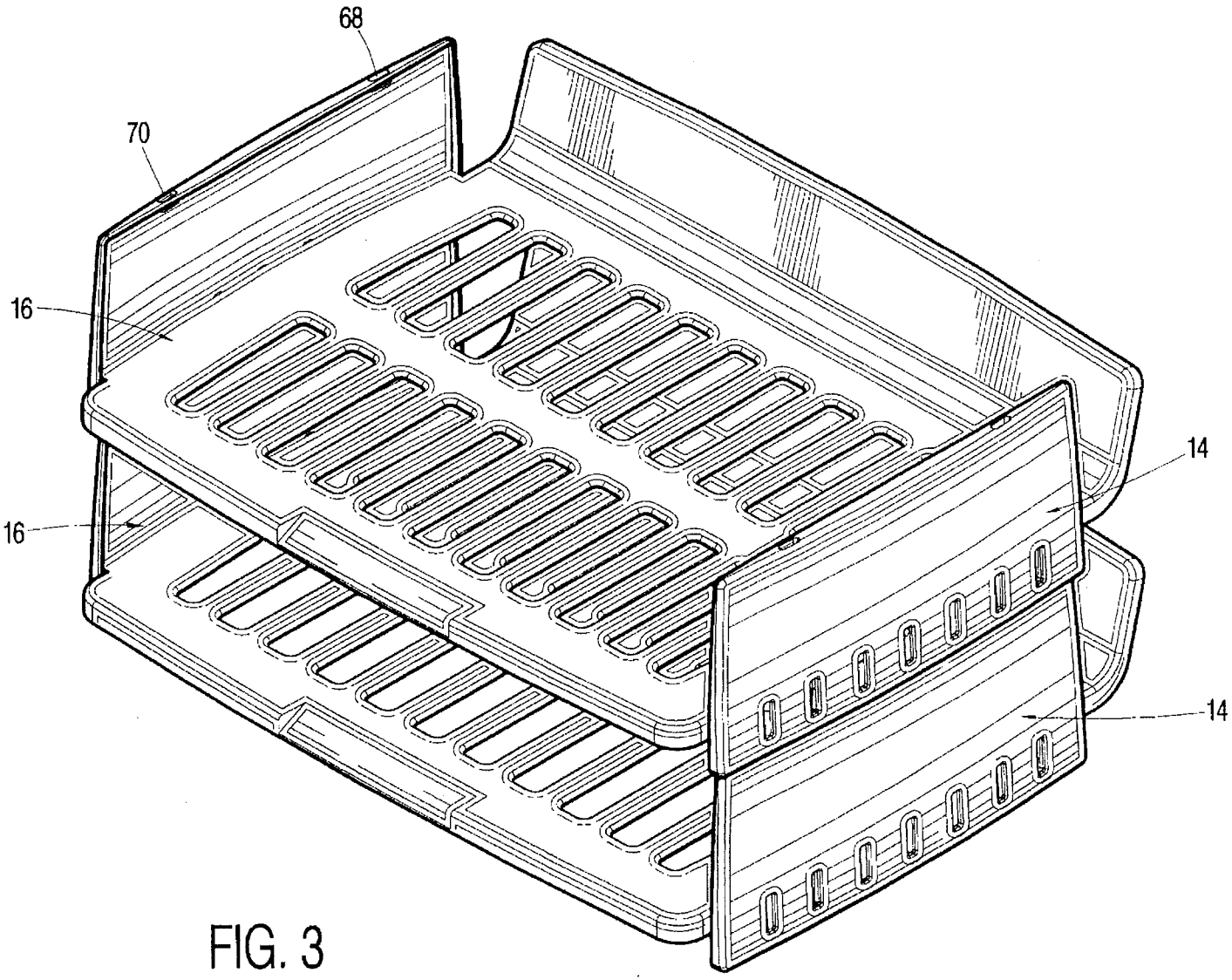
FIG. 3 is a perspective view of one assembled letter tray stacking upon another.
Figure 4:
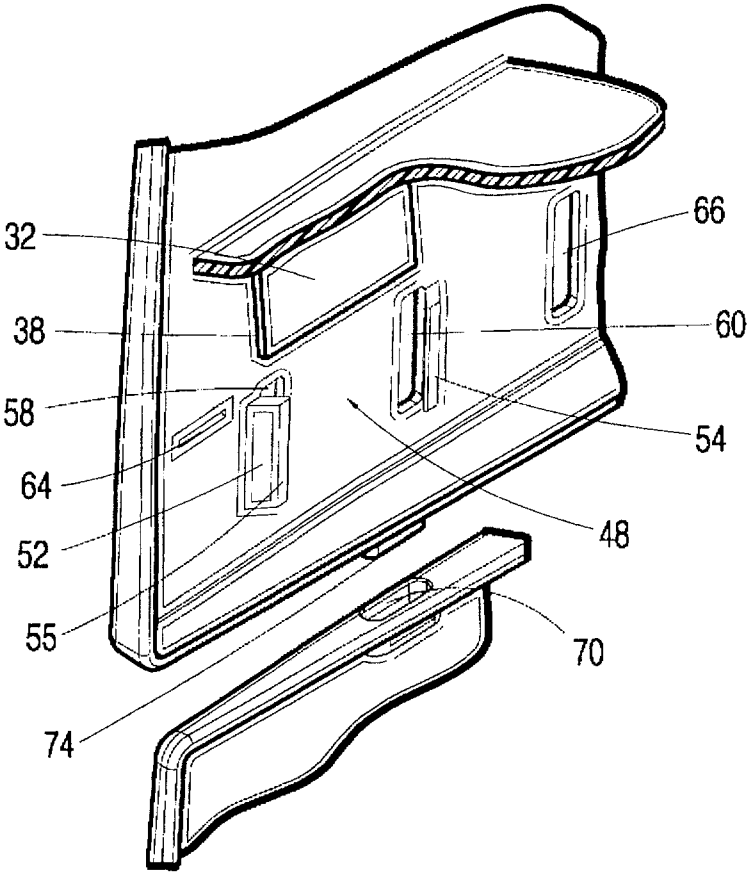
FIG. 4 is an enlarged perspective view of the dovetail socket and projection connection and the stacking foot and socket configuration.
Figure 5:
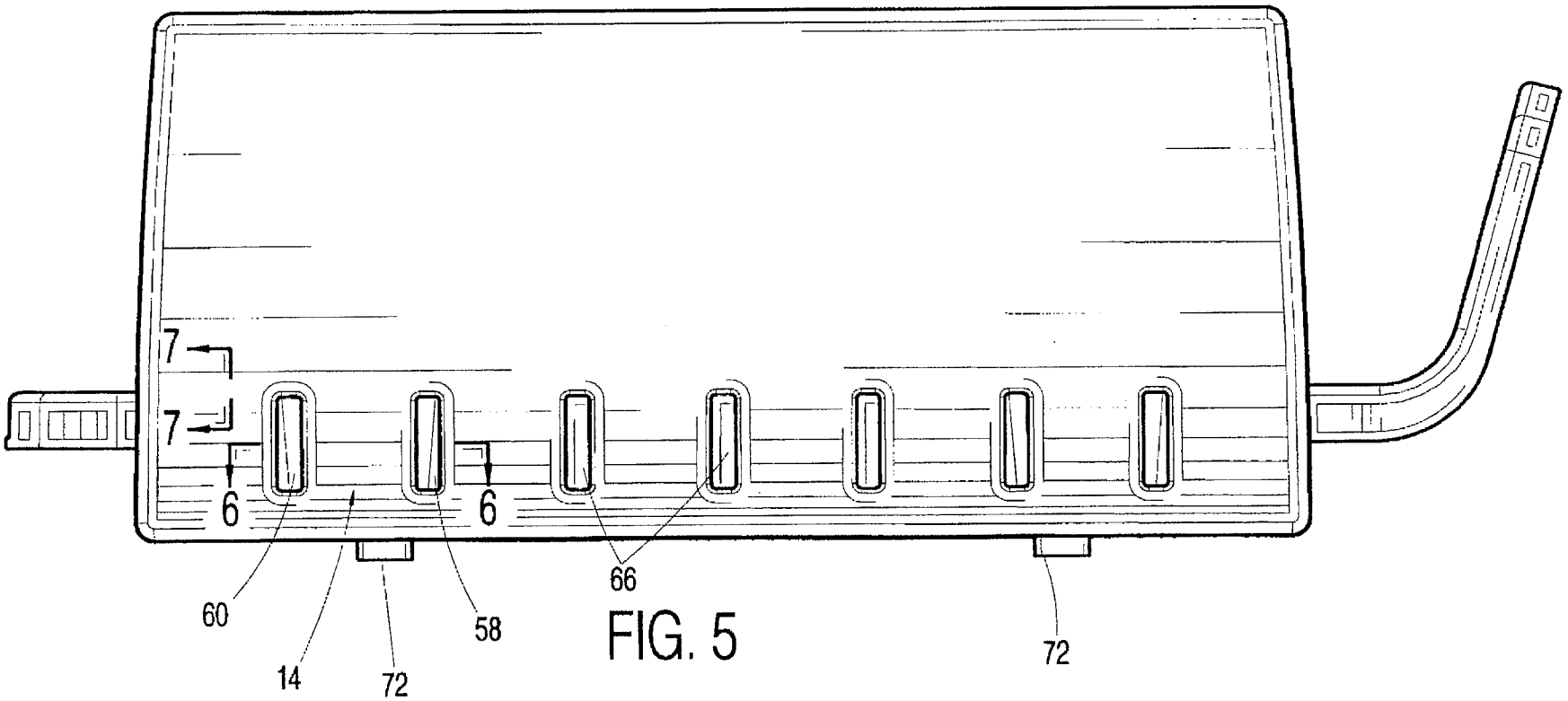
FIG. 5 is a side elevational view of the assembled letter tray.
Figure 6:
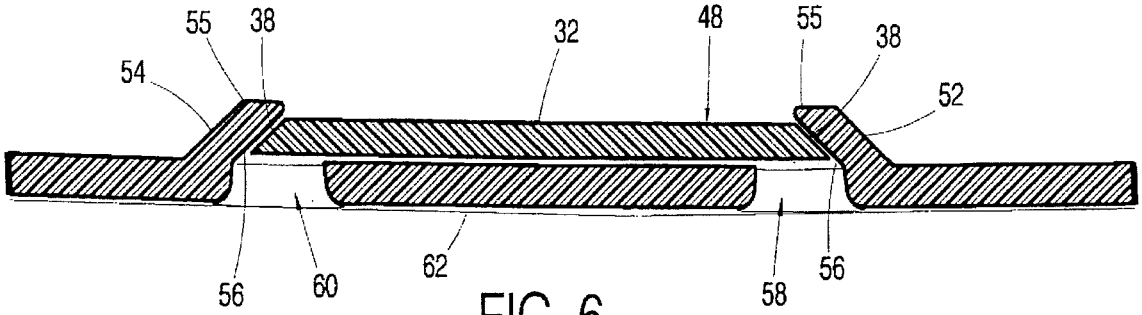
FIG. 6 is a sectional view through the dovetail interconnect, taken along the line 6—6 of FIG. 5.
Figure 7:
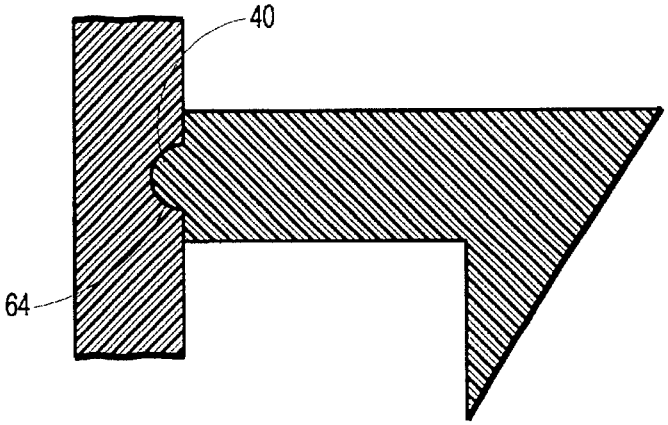
FIG. 7 is a sectional view through the locking interconnect, taken along the line 7—7 of FIG. 5.

A pair of stacking sockets 68, 70 extend into opposite ends of the upper portion of the peripheral flange 46, and a pair of mating configured feet projections 72, 74 extend into opposite ends of the lower portion of the peripheral flange 46. The feet projections of one side panel are intended for close insertion into the stacking sockets of another side panel, whereby one assembled tray may be stacked and secured atop another assembled tray as shown in FIG. 3.

Assembly of the subject tray kit proceeds as follows. The side panels 14, 16 are positioned adjacent to the opposite sides of the floor panel 12, with the sockets 48, 50 aligned with and below the dovetail projections 32, 36. The side panels sockets 48, 50 thereafter closely receive the projections 32, 36 as the side panels 14, 16 are moved upward. Full insertion of the projections 32, 36 into the sockets 48, 50 coincides with the entry of detent ribs 40 into the detent grooves 64, whereupon the side panels 14, 16 are secured to a respective side of the floor panel.

The rearward portion 26 of the floor panel 12 is concave and upwardly formed as shown in FIG. 2. It, together with the side panels 14, 16, assembled to the floor panel as described above, enclose the top surface of the floor panel and define a paper receiving compartment that is open to the forward end. The vertical stacking of one tray upon another as in FIG. 3, creates a tray column of general utility in office applications.

From the foregoing, it will be appreciated that the subject invention teaches a tray kit that collapses into three components. By stacking the side panels upon the floor panel, a compact configuration results that is economical to package and transport. Thereafter, the end user can assemble the side panels to the floor panel without hand tools or the need for fasteners.

Moreover, the rearward portion 26 of the floor panel 12 is of lower height than the side panels 14, 16. Hence, in the disassembled condition, with the side panels stacked upon the floor panel, the overall height of the disassembled kit is relatively small. Upon assembly, however, the relatively high side panels can retain a relatively high stack of papers, particularly if the tray rearward end 26 is backed against a vertical wall.

While the above describes the preferred embodiment of the subject invention, the subject invention is not intended to be so limited. Other embodiments, which will be apparent to those skilled in the art and which utilized the teachings herein set forth, are intended to be within the scope and spirit of the invention. By way of example, without limitation, the subject injection molded panels having integrally molded dovetail connections can find applications in diverse products. The general configuration of such dovetail connections is of utility, therefore, beyond their use in the construction of three sided enclosures such as in a tray.

I claim:

1. A storage tray comprising:

a floor panel having a forward end and a rearward end, and oppositely facing sides, each side comprising at least one outwardly projecting dovetail-shaped protrusion, the protrusion comprising an outwardly facing surface and beveled side surfaces extending from the outward surface toward the panel side;

a side panel having a forward end and a rearward end and an inward and outward facing side, the inward facing side comprising at least one inwardly directed dovetail-shaped socket comprising elongate first and second convergent cantilever flanges spaced apart a distance and closely receiving the protrusion outward surface of one floor panel side therebetween, the first and second cantilever flanges having a respective aperture associated therewith extending through the side panel from the outward to the inward facing side, and the aperture extending coextensively in length with its respective cantilever flange from a top flange end to a bottom flange end.

2. A storage tray according to claim 1, wherein the side panel attaches to the one floor panel side by the floor panel protrusion residing within the side panel socket, and the side panel thereupon extends parallel to the floor panel one side.

3. A storage tray according to claim 2, wherein the apertures are separated by a side panel portion and are of elongate substantially rectangular configuration.

4. A storage tray according to claim 3, wherein the side panel socket moves downward and receives the floor panel protrusion as the side panel is positioned and moves downward against the floor panel one side.

5. A storage tray according to claim 4, wherein the side panel inward side and the floor panel one side have engaging locking means for preventing reverse movement of the side panel socket from the floor panel protrusion.

6. A storage tray according to claim 5, wherein the locking means comprising a detent within the floor panel one side and a rib projection extending from the side panel inward side positioned to enter the floor panel detent.

7. A storage tray comprising:

a floor panel having a forward end and a rearward end, oppositely facing sides, and at least one side comprising at least one outwardly projecting protrusion, the protrusion comprising an outward facing surface and side surfaces extending from the outward surface toward the panel side;

at least one side panel having a forward end and a rearward end and an inward and an outward facing side, the inward facing side comprising at least one inwardly directed socket defined by elongate first and second cantilever flanges spaced apart a distance and closely receiving the protrusion of one floor panel side therebetween, whereby attaching the side panel against the floor panel one side and enclosing the one floor panel side, the first and second cantilever flanges having a respective aperture associated therewith extending through the side panel from the outward to the inward facing side, and the aperture extending at least coextensively in length and width with its respective cantilever flange from a top flange end to a bottom flange end.

8. A storage tray according to claim 7, wherein the apertures are separated by a side panel portion and are elongate in a vertical direction.

9. A storage tray according to claim 8, wherein the one side panel and the floor panel one side having engaging locking means for preventing reverse movement of the floor panel protrusion from the one side panel socket.

10. A storage tray according to claim 9, wherein the locking means comprising a detent within the floor panel one side and a rib projection extending from the one side panel inward side and entering the floor panel detent.

11. A storage tray according to claim 10, wherein the protrusion and the socket have a complimentary dovetail shape.

12. A storage tray assembly comprising multiple component parts, the parts comprising:

a floor panel having a forward end and a rearward end, oppositely facing sides, and at least one outwardly projecting protrusion extending from each of the panel sides;

a first and a second detached side panel, each having a forward end and a rearward end and an inward and an outward facing side, the inward facing side comprising at least one outwardly directed socket defined by elongate first and second cantilever flanges, the flanges being spaced apart a distance and closely receiving a respective protrusion of a respective floor panel side therebetween, whereby attaching the side panel against the respective floor panel side, and the first and second cantilever flanges having a respective elongate aperture adjacently positioned thereto, the aperture extending at least coextensively in length and width as the cantilever flange adjacent thereto.

13. A assembly according to claim 12, wherein the apertures are separated by a side panel portion.

14. A assembly according to claim 13, wherein the protrusions and the side wall sockets have a complimentary dovetail shape.

15. A assembly according to claim 14, wherein the floor panel rearward end comprises an upturned concave panel segment for enclosing the rearward end of the floor panel and the concave panel segment, the floor panel, and the side panels defining an enclosure for containing articles upon the floor panel.

16. A assembly according to claim 15, wherein the side panels and the floor panel sides having engagement locking means for preventing reverse movement of the side panels out of attachment to the floor panel.

17. A assembly according to claim 16, wherein the locking means comprising a detent within each floor panel side and a rib projection extending from each side panel inward side positioned to enter a respective one of the floor panel detents.

* * * * *